US005259535A

United States Patent [19]

Boyte, Sr.

[11] Patent Number: 5,259,535

[45] Date of Patent: Nov. 9, 1993

[54] OUTLET FUNNEL WITH ORIENTED FLOATING STOPPER, FOR POURING FROM LIQUID CONTAINER WHILE SECURED THERETO

[76] Inventor: James M. Boyte, Sr., Star Rte., Box 55-A, Carthage, N.C. 28327

[21] Appl. No.: 902,814

[22] Filed: Jun. 23, 1992

Related U.S. Application Data

[63] Continuation-in-part of Ser. No. 668,140, Mar. 11, 1991, Pat. No. 5,133,479.

[51] Int. Cl.[5] ..... B65D 37/00

[52] U.S. Cl. ..... 222/207; 222/213; 222/460

[58] Field of Search ..... 222/51, 206, 207, 211, 222/212, 213, 425, 460, 461, 462, 523, 525, 531, 563

[56] References Cited

U.S. PATENT DOCUMENTS

| | | | |
|---|---|---|---|
| 756,546 | 4/1904 | Van Benthuysen | 222/206 |
| 3,172,575 | 3/1965 | Vosburg | 222/185 |
| 3,256,977 | 6/1966 | Pettersen | 222/190 |
| 3,366,285 | 1/1968 | Scislowicz | 222/383 |
| 4,162,749 | 7/1979 | Bennett | 202/207 X |
| 4,696,328 | 9/1987 | Rhodes, Jr. | 141/1 |
| 4,789,082 | 12/1988 | Sampson | 222/1 |
| 4,842,152 | 6/1989 | Donegan | 215/294 |
| 4,846,378 | 7/1989 | Kim | 222/479 |
| 4,938,390 | 7/1990 | Markva | 222/206 |
| 4,946,075 | 8/1990 | Lundback | 222/207 X |
| 5,000,353 | 3/1991 | Kostanecki | 222/212 |
| 5,110,051 | 5/1992 | Bennett | 222/211 X |

FOREIGN PATENT DOCUMENTS

| | | | |
|---|---|---|---|
| 2098958 | 12/1982 | United Kingdom | 222/207 |

*Primary Examiner*—Andres Kashnikow
*Assistant Examiner*—J. A. Kaufman
*Attorney, Agent, or Firm*—Cushman Darby & Cushman

[57] ABSTRACT

A container having a threaded tubular neck out through which a contained liquid can be poured is provided with a screwed on outlet funnel. The outlet funnel houses a liquid-buoyant, invertible stopper, which is heavier towards an end provided with a sealing-preventing feature, than towards a diametrically opposite end provided with a sealing-providing feature. The container itself may be of conventional construction. The funnel possibly telescopes for selectively locking the stopper in place in either an orientation in which it seals to prevent liquid from entering the funnel from the container, or to prevent liquid from pouring from the funnel.

11 Claims, 7 Drawing Sheets

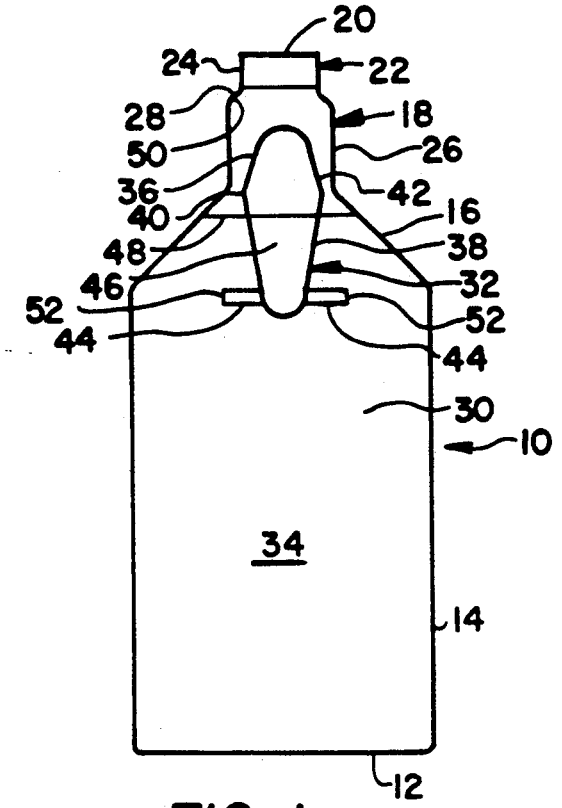
FIG. 1
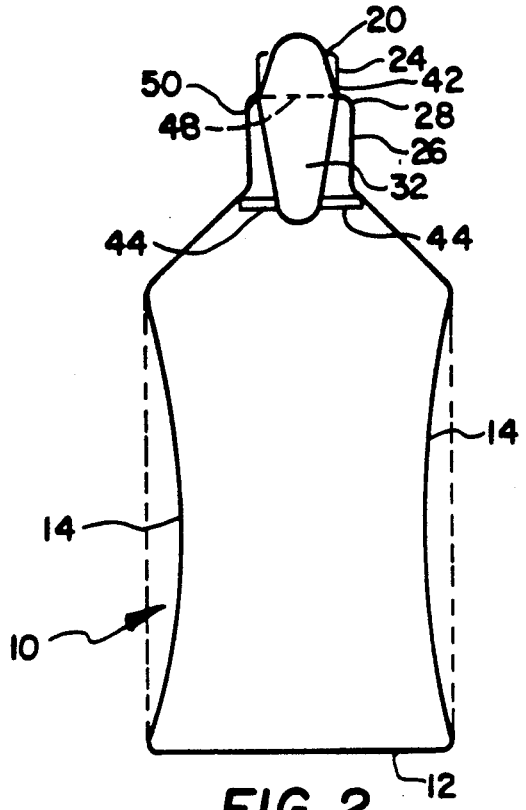
FIG. 2
FIG. 3
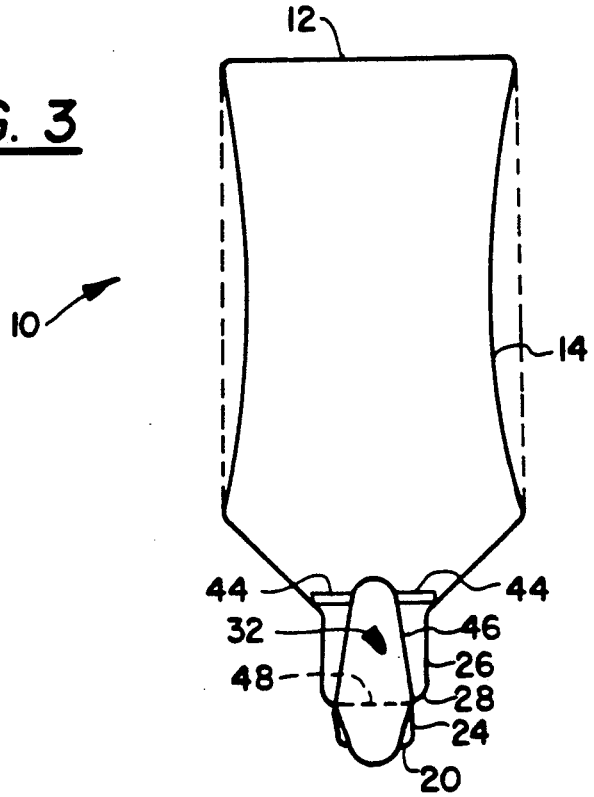

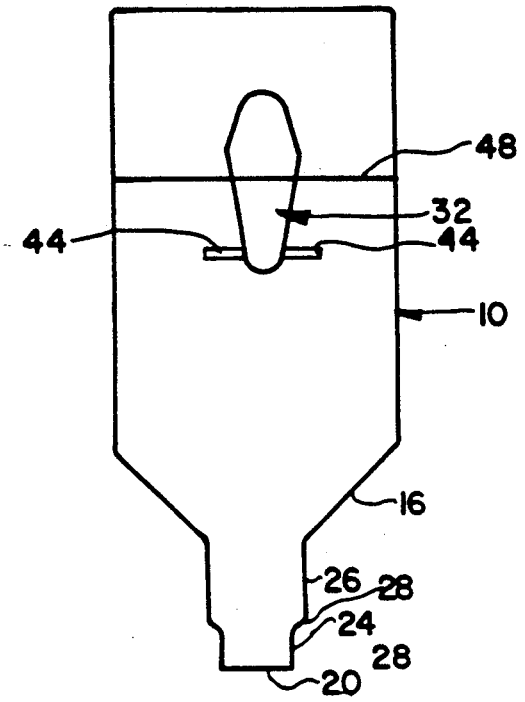
FIG. 4
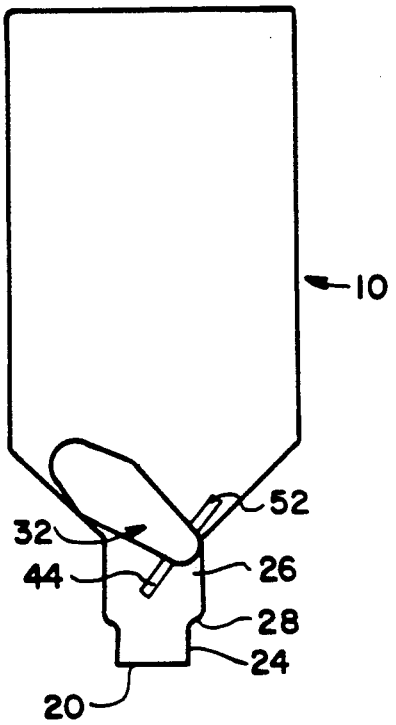
FIG. 5
FIG. 6
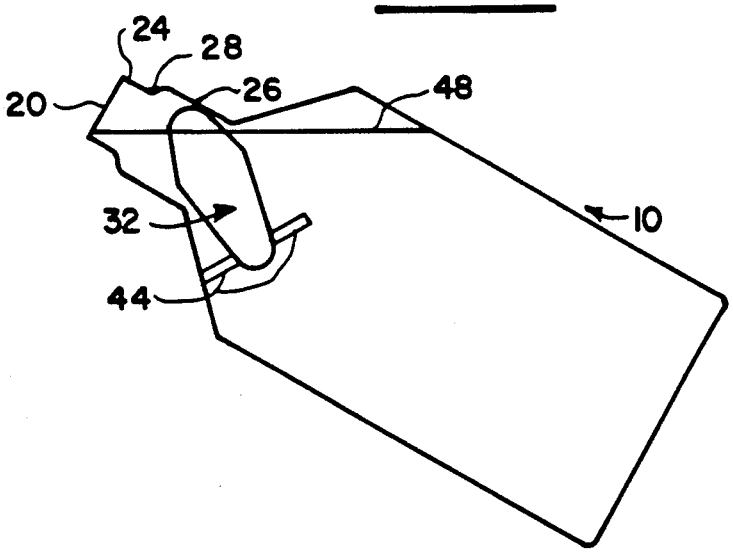

OUTLET FUNNEL WITH ORIENTED FLOATING STOPPER, FOR POURING FROM LIQUID CONTAINER WHILE SECURED THERETO

REFERENCE TO RELATED APPLICATION

This is a continuation-in-part of my application Ser. No. 07/668,140, filed Mar. 11, 1991, now U.S. Pat. No. 5,133,479 issued Jul. 28, 1992.

BACKGROUND OF THE INVENTION

It is difficult, without spilling, to pour oil from a usual can, bottle or similar container into the filler inlet for an automotive engine oil reservoir, unless a funnel is used. That is because the container usually has a short neck (or no neck), the container usually is nearly completely full, and the vicinity of the filler inlet may be obstructed by other structures. In time of need, a funnel may not be available. This leads to undesirable spills and to an undue reluctance to give proper attention to adding oil to the engine.

Although engine oil is given as a ready example, there are other situations in which a comparable problem arises due to the difficulty of pouring a liquid, without spillage, from an open neck of a container, without the aid of a funnel.

In my aforementioned earlier U.S. Pat. No. 5,133,479 I have disclosed a container for a liquid which is to be poured out of the container through an open neck, is internally provided with a buoyant stopper for the neck. The stopper is oriented, by uneven weight distribution, to float in a stop surface up, flexible tabs down orientation. In use, the container, after being opened, is slightly squeezed to elevate the stopper stop surface into sealing engagement with the neck. In this condition, the container is inverted and its open neck placed over the intended receiver, whereupon manual squeezing is relaxed, allowing the stopper to bob up towards the bottom of container. Inversion, while bobbing up, desirably orients the stopper so that, as the stopper settles into the container shoulder or neck during emptying, it cannot undesirably replug the container neck. The stopper can be inserted into the container during the container manufacturing process, by flexing the tabs and forcing the stopper into the container through the neck, tab end first.

At least insofar as the disclosed preferred embodiment of my prior invention is concerned, the container is a specially made one, since the oriented stopper is provided in an integral portion of the neck of the container.

SUMMARY OF THE INVENTION

The applicability of the preferred embodiment disclosed in my earlier U.S. Pat. No. 5,133,479 is improved by providing, in effect, a threaded joint in the filler neck, so that the oriented floating stopper is provided in an outlet funnel which disconnectably connects with the threading on the filler neck of a container for liquid. Accordingly, the container itself may be of conventional construction. The funnel telescopes for selectively locking the stopper in place in either an orientation in which it seals to prevent liquid from entering the funnel from the container, or to prevent liquid from pouring from the funnel.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the drawings:

FIGS. 1–6, which are carried forward from my above-identified earlier application, are briefly described as follows:

FIG. 1 is a somewhat schematic longitudinal sectional view of a container, full of liquid, on the upper surface of which is floating a buoyant, oriented stopper provided on axially opposite ends with a stop surface and a set of flexible tabs;

FIG. 2 is a similar view, showing the stopper in neck-plugging condition due to transverse squeezing of the container body after the container cap has been opened;

FIG. 3 is a similar view, showing the container still squeezed, but after inversion, with the stopper still plugging the neck;

FIG. 4 is a similar view, showing how the stopper bobs upward toward the bottom of the inverted container, thus opening the container mouth, and inverts, upon discontinuation of transverse squeezing of the container body;

FIG. 5 is a similar view showing how, as the container empties of liquid through the mouth of its open neck, the tabs prevent the stopper from reclosing the neck; and FIG. 6 shows how liquid may be conventionally poured from the container, if desired, without performing the temporary plugging step that is illustrated in FIGS. 2 and 3.

FIG. 7 is a somewhat schematic longitudinal sectional view of an outlet funnel with an oriented floating stopper, constructed in accordance with the principles of the present invention, and shown removably threaded onto the neck of a conventional liquid container, e.g., a blow-molded flexible polypropylene quart container for automotive engine oil;

FIG. 8 is a similar view, showing the stopper in funnel outlet neck-plugging condition, due to transverse squeezing of the container body;

FIG. 9 is a similar view, showing the container still squeezed, but after inversion, with the stopper still plugging the funnel outlet neck;

FIG. 10 is a similar view, showing how the stopper bobs upward towards the inverted container, thus opening the funnel outlet neck, and inverts, upon discontinuation of transverse squeezing of the container body;

FIG. 11 is a similar view, showing how the funnel body can be telescopically contracted, for forcing the floating stopper into sealing relation with the inlet tube of the funnel, thereby effectively closing off flow of additional liquid from the container into the funnel, e.g., so that the container with the funnel attached can be reverted to an upright position;

FIG. 12 is a somewhat schematic longitudinal sectional view, similar to FIG. 8, but showing an alternate mode of use, in which telescopic contraction of the funnel body, rather than transverse squeezing of the container body is used for maintaining the plug in a funnel outlet-blocking condition so that the funnel-container assembly can be inverted without immediately spilling liquid from the container out through the funnel;

FIG. 13 is a similar view, showing a stage subsequent to the one depicted in FIG. 12, in which, after the funnel-container has been inverted, the funnel body has been telescopically expanded, creating a vacuum within the funnel body that pulls the plug and allows the plug to invert so that liquid can pour from the container into the funnel and out of the funnel through the funnel outlet neck;

FIG. 14 is a longitudinal sectional view of the funnel showing threadedly attached to its outlet neck an adapter for use in pushing the stopper away from sealing relation to the outlet neck should it be needed in the FIG. 8 or especially the FIG. 12 to 13 condition of the funnel-container assembly (e.g., if the container is tall, or provides insufficient headspace to create the requisite vaccuum to suck the stopper out of sealing relation); and FIG. 15 is a longitudinal sectional view of the funnel showing a J-hook plug attached for hangingly storing the funnel, e.g., at a convenient location within the engine compartment of an automobile.

DETAILED DESCRIPTION

Figure 7:
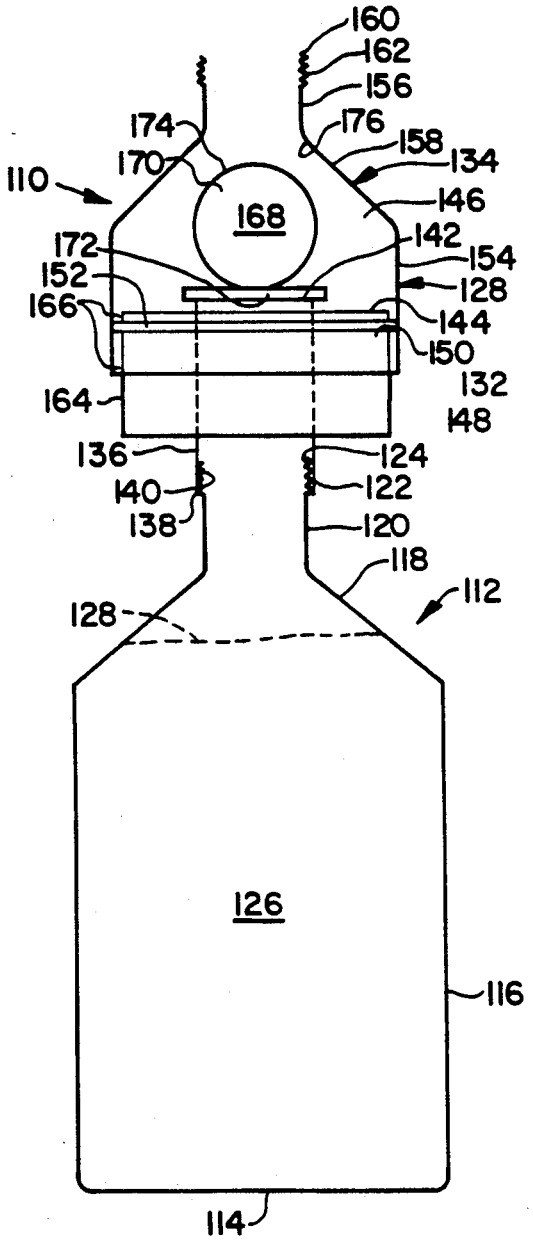
FIGS. 7–15, which show the outlet funnel that is the subject of the present invention, are briefly described as follows.
Figure 8:
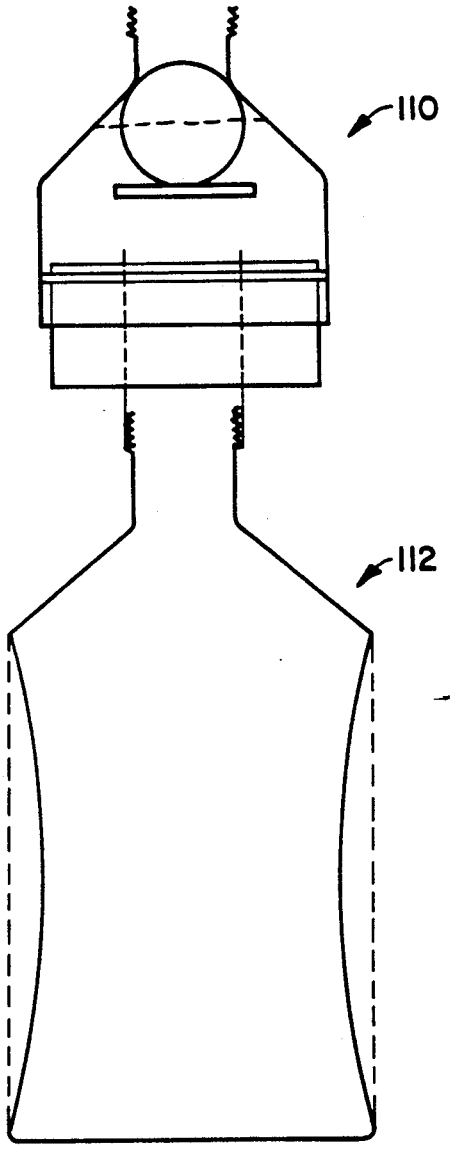

A container is illustrated at 10 in FIG. 1. In the preferred embodiment, the container is a one-quart container for automotive engine oil, e.g., blow molded out of polyethylene or polypropylene. (In fact, the size and/or contents may be different.) Typically, although not essentially, the container 10 is circular in transverse cross-sectional shape, although it need not be. It is shown having a bottom wall 12, an upstanding outer peripheral sidewall 14, an upper end wall, preferably in the form of an upwardly tapering shoulder 16 at the upper end of the sidewall, and a tubular neck 18, having an open end 20. The mouth 20 at the end of the neck is preferably suitably openably closed by a seal cap 22 or other closure, which may be designed to be screwed off, twisted-off, pushed, twisted or pulled open, pierced, broken, pried-off, cut-off, or otherwise manipulated for opening the neck at the mouth.

The neck 18, between its axially inner and outer ends, has a structural feature which effectively provides a construction in internal diameter, as experienced in the direction of outflow of liquid from the container through the neck. Thus, the neck has a minimum internal diameter at 24, below the constriction, which is greater than its minimum internal diameter at 26, at the constriction. The constriction 28 may take the form of an abrupt step-down in the internal diameter of the neck at a frusto-conical band, so that the neck has a smaller internal diameter above than below the band.

Contained within the internal cavity 30 of the container 10, is a buoyant stopper 32 (also known as a floater). The floating stopper 32 is a structure which is differentially buoyant along a longitudinal axis, so that it has a remarked tendency to float on the surface of a liquid 34 contained in the cavity 30 with one end up, and an opposite end down. The floating stopper preferably has the shape that is illustrated in the drawing figures, including a body of revolution, elongated about its longitudinal axis, each end being bluntly conical, with the upper, less-dense end 36 tapering at a greater angle to the longitudinal axis than does the lower, more-dense end 38.

The upper end is preferably axially shorter than the lower end, by being more blunt. Thus, at the intersection of (or between) the upper and lower end portions, the floating stopper 32 has an encircling region 40 of maximum external diameter, which, on the upper portion 36, provides a tapered circumferential sealing surface 42.

The relative sizes and shapes of the stopper and neck are such that the sealing surface 42 is capable of circumferentially sealing off from the cavity 30, the smaller diameter portion 24 of the neck 18 at the constriction 28.

The lower portion 38 of the stopper 32 is shown provided with two or more laterally projecting tabs 44. Preferably, the tabs 44 are made of resiliently flexible material, so that the stopper 32 can be inserted in the cavity 30 by temporarily condensing, bending or flexing the tabs against the body of the stopper, and inserting the stopper 32 through the open neck 18, into the cavity 30. This is preferably done before the container is filled with liquid.

If the stopper body has a maximum external diameter that is larger than the minimum internal diameter of the neck at the constriction 28, a proper technique must be used for inserting the stopper into the cavity.

This can be done by application of moderate force axially on the stopper, e.g., much as one can force the cork on a wine bottle down into the bottle despite the fact that the cork is force fit in the bottle neck because its free outer diameter is larger than the internal diameter of the bottle neck. In that case, resilience of the stopper body is a key to proper installation. Thus, the stopper in the instance of the present invention may be made of traditional resilient bottle stopper material, such as cork, and cork substitutes such as foamed plastic and rubber. Of course, it should be made of material that is carefully selected not to adversely react with or contaminate the liquid which is to be contained in the container, nor to be susceptible to destructive decomposition therein, e.g., due to fermentation, oxidation or other attack by chemicals or micro-organisms.

If the stopper 32 is molded of synthetic plastic resin, its body 46 can be foamed, and its tabs 44 integrally molded with the body, but nonfoamed, so as to provide the lower portion 38 with a greater density. Alternatively, the body 46 may be foamed, and a nonfoamed flexible element of plastic material pierced transversally through the body 46 to provide the tabs 44.

In any event, when the container containing the stopper 32 is conventionally filled with liquid to a usual level, the stopper 32 floats on the surface 48 of the liquid 34. The degree to which the stopper is partially submerged in the liquid, of course depends on the density of the stopper relative to the liquid. The preferred situation is as depicted, e.g., the stopper 32 floats with the maximum diameter region 40 at or above the surface 48, with the upper portion 36 nosed into the larger diameter portion 26 of the neck, with the stopper's sealing surface 42 located generally coaxially with, but spaced axially below the axially downwardly facing seat 50 provided on the constriction 28.

If a person wishes to pour all of the liquid contents of cavity 30 into an engine oil intake (or other receiver) using a preferred method according to the present invention, the person, while holding the container 10 upright, or nearly upright, opens the closure 22, and then transversally squeezes the sidewall 14 of the container (e.g., as depicted in FIG. 2). The squeezing action (because the container is resilient or at least flexible-walled) reduces the volume in the cavity of the container, thereby causing the level of the surface 48 to rise towards, into or in the neck, towards the mouth 20. Accordingly, the stopper 32 rises, causing the sealing surface 42 to move axially into surface to surface circumferential sealing engagement with the annular seat 50, thereby effectively reclosing the neck 18 of the container.

By preference, as shown, the squeezing of the container sidewall 14 is accomplished by a person, e.g., with one or both hands, grippingly engaging the sidewall at two generally diametrically opposed locations, and squeezing these locations towards one another.

With the container sidewall so-squeezed, and the stopper thereby elevated into mouth-blocking relation in the neck 18, the person inverts the container (FIG. 3). The length of the stopper from the sealing surface 42 to the tabs 38, relative to the length of the container from the seal 50 to the region of the junction of the shoulder 16 with the neck 18 is such (taking also into account the flexibility of the tabs 38), that the sealed condition can be provided at 42/50 without such condition being prevented by the engagement of the tabs 38 with the shoulder 16 adjacent the juncture of the shoulder 16 with the neck 18.) The user then places the mouth 20 over the intended receiver, then somewhat relaxes his or her squeezing grip on the sidewall. Upon resulting release of hydrostatic pressure on the rear of the stopper from within the cavity, the buoyancy of the stopper causes the stopper to bob upwards to the bottom of the container, inverting as it moves (FIG. 4). (For this reason, the diameter, or width, of the container cavity, in the body of the container, must be longer than the effective top-to-bottom axial length of the stopper. Now, the container mouth 20 is open for the outflow of liquid 34, and the liquid upper surface 48 faces the container bottom wall 12 (i.e., the "headspace" of the cavity 30) is contiguous with the bottom wall 12 of the container, and the stopper part having the tabs 44 is oriented axially towards the juncture of the container neck 18 with the shoulder 16.

As liquid drains out of the mouth 20, the liquid level 44, and therefore, the floating stopper 32, descend towards the container mouth. However, before the stopper lower end can descend far enough into the container neck as to plug the neck and thus the mouth of the container, the outer ends 52 of the tabs 44 engage the shoulder 16 (the effective width of the tab structure, from end 52 to end 52 being greater than the diameter of the base of the neck), so that the liquid can continue to drain out of the mouth of the container until the container is empty.

In practice, the exterior of the container would likely be provided with a set of graphics and verbal instructions showing and explaining how to use the technique which has been explained above with reference to FIGS. 1-5.

of course, despite the presence of the floating stopper in the container, the container could be opened and conventionally partially or completely emptied of its contents, as illustrated in FIG. 6. In such cases, the construction of the floating stopper relative to the container prevents the stopper from plugging the container mouth (other than intentionally) by practicing the steps illustrated in FIGS. 2 and 3 while the container remains sufficiently full of liquid.

Also, it is possible to use the container 10 for shuttling liquid to a receiver, since, once it has been emptied, it can simply be conventionally refilled, and the procedure explained above repeated.

Although, in the preferred embodiment, the container neck is of an internal diameter that is smaller than the maximum diameter of the stopper at 40 due to the as-molded dimensions of these two parts, it would be within the concept of the invention to apply to the neck (after the stopper has been inserted in the cavity) a structure (such as a thermally welded-in-place ring) that constricts the neck, or to make the stopper, or an encircling ring on the stopper out of a material that expands or swells after the stopper is in place (e.g., due to slow recovery of an elastic compression of a foamed plastic material).

FIGS. 7-15 depict a preferred embodiment of the outlet funnel 110 of the present invention, shown (in FIGS. 7-13) disconnectably connected to a liquid container 112, for use in controlling pouring of liquid from the container. The funnel may be made of the same materials and by the same methods as can be used for making the integrated container-funnel embodiment that has been described above with reference to FIGS. 1-6. The container 112 may be an utterly conventional container, e.g., a blow-molded, polypropylene one-quart automotive engine oil container. Inasmuch as the funnel 110 of the present invention is useful, both with containers that do and do not have transversally squeezably flexible body sidewalls, the container 112 can be flexible or rigid walled.

For convenience in description, the container 112 which is shown, is a conventional one-quart plastic oil can with a one-piece blow-molded flexible polypropylene body having a body portion with a bottom end wall 114, a peripheral sidewall 116 and a tapering upper end wall 118, and a tubular neck 120 having an outer end that is externally helically threaded at 122 for removable receipt of a conventional closure cap (not shown, having been removed). The outer end of the neck 120, with the cap removed, is open at 124. It is through this opening that the bottle is conventionally filled with a liquid 126 such as engine oil, e.g., to the level 128, and through which the liquid is normally intended to be poured out, e.g., by sufficiently tilted or inverting the bottle, with its closure cap removed.

At the stage depicted in FIG. 7, the closure cap has been removed and, in its place, a funnel 110 that is constructed in accordance with the principles of the present invention has been removably securely mounted to the container 112, by screwing it onto the band of threading 122.

The funnel 110 comprises a body that can be differential pressure thermoformed, blow molded or otherwise molded of plastics conventionally used for making conventional liquid containers and funnels.

In the preferred embodiment, the funnel body 130 is provided as two telescopically related sections, including an inlet section 132 and an outlet section 134.

The inlet section 132 includes an inlet tube 136 having an open lower end 138 provided with an internal band of helical threading 140 and an open upper end 142. The inlet section 132 further includes an annular bottom wall or floor 144 which generally radially extends outwards from the inlet tube 136 at or near the upper end 142. By preference, the floor 144 is slightly upwardly flaringly frusto-conical and at its radially inner extent is integral with the upper end of the inlet tube 136, so that any residual liquid draining down the internal wall surfaces of the funnel chamber 146, will flow towards and into the upper end of the inlet tube 136 (when the funnel-container assembly is upright and the upper end 142 is open).

At its radially outer extent, the floor 144 is coaxially provided with a depending tubular skirt 148 which as a radially outwardly opening circumferential groove 150 in which there is seated an annular resilient sealing ring 152 which also protrudes radially outwardly from the groove.

The outlet section 134 of the funnel includes a larger diameter tubular body wall 154, a smaller diameter tubular outlet neck 156 and, integrally coaxially connecting these tubular portions, a frusto-conical shoulder wall 158. The lower end of the body wall 154 is open, as is the upper end of the outlet neck 156 (at 160).

Preferably, the upper end of the outlet neck is also provided with a band of external helical threading 162 (which, most conveniently, may replicate the threading at 122 on the container neck), so that the same cap which has been taken off of the container can be used to removably close the upper end of the outlet neck.

The internal threading 140 on the lower end of the inlet tube 136 of the inlet section 132 of the funnel body is sized to permit the funnel 110 to be removably securely threaded onto the threading 122 on the neck 120 of the container 112, so as to create for use a funnel-container assembly 110, 112.

The radially inner sidewall surface 164 of the body wall 154 is substantially cylindrical and sized for sliding circumferential sealing engagement with the sealing ring 152. It should be apparent that the same practical result will be achieved if the sealing ring seats in a groove in the surface 164 and slidingly seals with the radially outer surface 164 on the skirt 148, all of which is within the concept of the present invention.

By preference, the skirt 148 and body wall 154 are provided with interengagable lip or shoulder means 166 which, by engaging, limit telescopic expansion of the funnel (i.e., prevent accidental longitudinal disassembly of the funnel body sections 132, 134 from one another).

Figure 10:
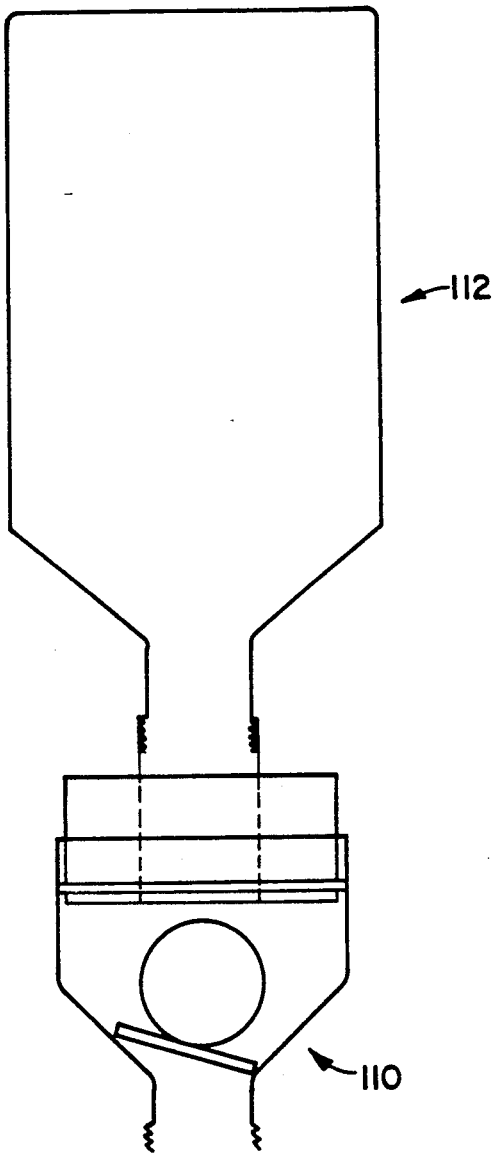
Figure 13:
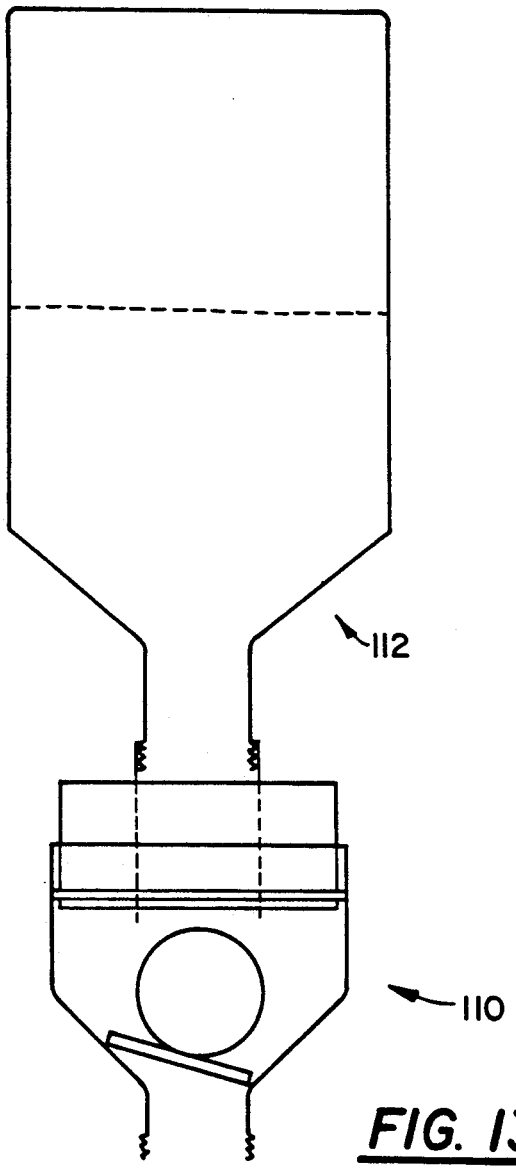

The funnel 110 further includes a buoyant self-orienting plug 168, shown comprising a ball 170 having a bar 172 secured at one external location. In fact, the ball 170 is internally weighted eccentrically of the ball center, along a diameter of the ball, and the bar 172 extends transversally of the generally tangent to the outer surface of the ball where that diameter intersects the outer surface of the ball. The bar is provided on the side of the ball that is pointed downwards when the ball is floating. The bar 172 can be straight, X-shaped, asterisk-shaped or the like. The bar needs to be long enough to be able to rest on the upper end of the inlet tube 136, and long enough to bridge in the wall portion 158 of the funnel when the assembly 110, 112 is inverted (FIGS. 10 and 13). The bar 172 needs to have effective openings through it or beside it (i.e., it cannot be an imperforate disk), because, when the assembly is in its FIG. 10 and FIG. 13 position, and the plug is in the position shown in those Figures, it is essential that liquid contained in the container be able to flow through the funnel, past the plug, and out of the funnel through the outlet neck 156. Likewise, when the funnel-container assembly 110, 112 is in its FIG. 7 position, it is necessary to the operation that is described below with reference to FIG. 8 that air in the headspace of the container be able to flow out past the plug as the container sidewall 116 is laterally squeezed causing the liquid level 128 to rise.

Figure 11:
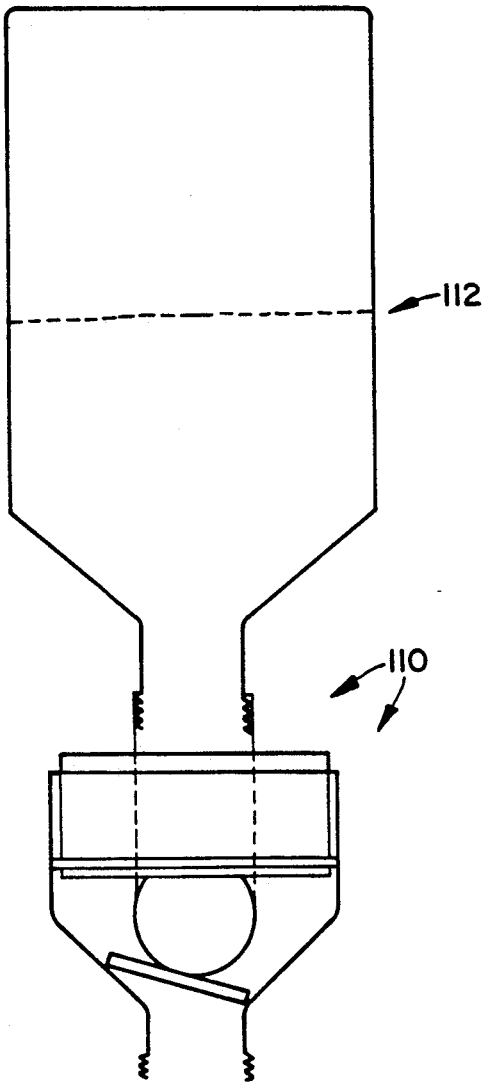

It is further necessary that the diameter of the ball on the side opposite the bar be greater than the internal diameters of the outlet neck 156 when it meets the wall 158, so the round side 174 of the plug can form an annular seal with the internal surface 176 of the wall 158 circumferentially of the neck 156. Also, the ball needs to be larger in diameter than the internal surface of the end 142 of the inlet tube 136, so the round side 174 of the plug can seal the end 142 at the stage which is depicted in FIG. 11 (if the telescopic preferred embodiment of the funnel is to be provided and used).

The ball needs to be sufficiently low in density as to be able to float on motor oil or whatever other liquid is to be poured from the container 112 under control of the funnel 110.

When the funnel is to be used in the manner depicted in FIGS. 7–10, the effective length of the funnel chamber 146 must be such as to permit the plug 168 to come out of a sealing position at point 176 (FIG. 7) and, while floating, to rotate sufficiently that the bar prevents the ball from replugging the opening at point 176 (FIG. 7). Without a full rotation of 180 degrees, the floater would have its total sealing effect at point 176 (FIG. 7).

In the mode of use that is depicted in FIGS. 7–10, the funnel 110 is screwed onto the neck of the container 112 from which liquid 126 is to be poured under control of the funnel 110. Then, the sidewall 116 of the container is manually squeezed from opposite sides (from the full lines to the dashed lines shown in FIG. 8), thereby decreasing the internal volume of the container, causing the liquid level 128 to rise from the container 112, into the funnel chamber 146, thereby floating the plug 168 upwards until the round side 174 of the ball 170 seals with the internal surface 176 of the wall 158 circumferentially of the neck 156.

Figure 9:
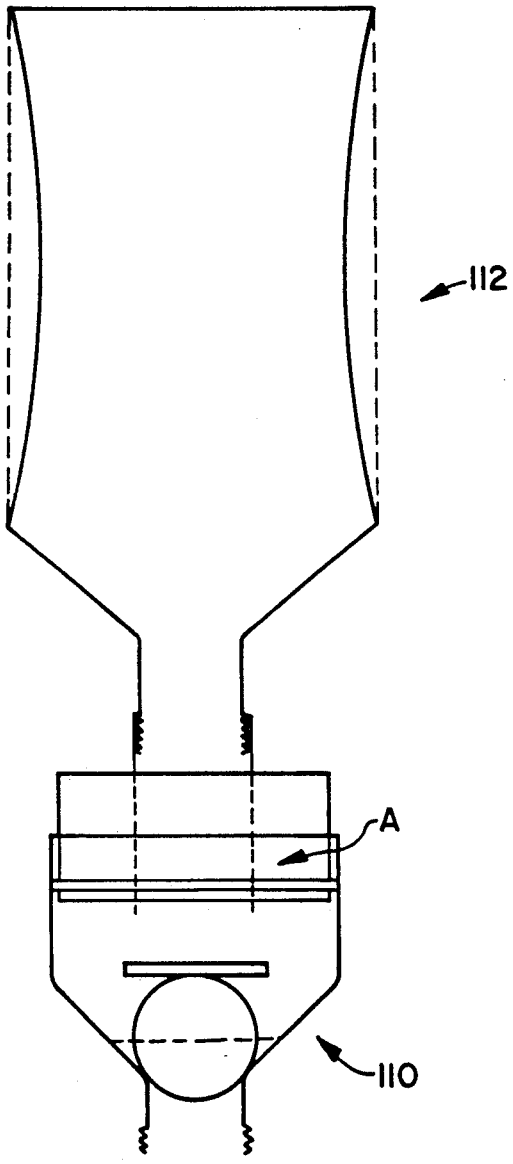

While maintaining manual compression on the container sidewall, the user then inverts the funnel-container assembly 110, 112, and places the outer end 160 of the outlet neck 156 in line with whatever structure is intended to receive the liquid which is to be poured out (e.g., over the oil filler tube of an automotive engine). The funnel-container assembly 110, 112 at this time has the orientation and condition that are generally depicted in FIG. 9. The round side of the plug continues to effectively close the outlet neck of the funnel.

When the user has the outlet neck properly positioned and wants the liquid to pour out of it, he or she then eases off on squeezing the container sidewall, whereupon the plug rises away from sealing relation with the wall surface 176 and rotates 180°, so that the bar 172 is situated under the ball (FIG. 10). Accordingly, the bar prevents the ball from effectively blocking the outlet neck of the funnel, as the liquid flows out of the container, through the funnel chamber and out of the outlet neck of the funnel. Despite the buoyancy of the plug, the downflow of liquid at this time prevents the uppermost round side of the ball from effectively plugging the inlet tube of the funnel. Under conditions that the downflow of the liquid might not prevent the ball from floating upward, the inlet neck at point A (FIG. 9) could be designed in an elliptical shape. Thus, only under manual pressure would the elliptical shape become circular when in contact with the floater. Only in a circular shape would the flow stop.

If the user, while pouring from the container through the funnel in the position shown in FIG. 10 wants to discontinue pouring, yet so much liquid remains in the assembly that the user believes that they will spill too much if they simply tilt the assembly back to an upright position, the user of the preferred (telescopic body) embodiment has another option. That is, the user can telescopically axially condense the funnel (by pushing the free end of the skirt 148 and the shoulder 158 axially towards one another), thereby forcing the round side 174 of the ball up into sealingly closing relation with the inlet tube of the funnel. The liquid downstream of the plug then drains through the outlet neck and the user can confidently revert the assembly to its upright position.

Of course, the funnel body 130 could be provided as a unitary or integral non-expansible, non-condensible article, if one were willing to forego the added functionality that has been described with relation to FIG. 11.

Figure 12:
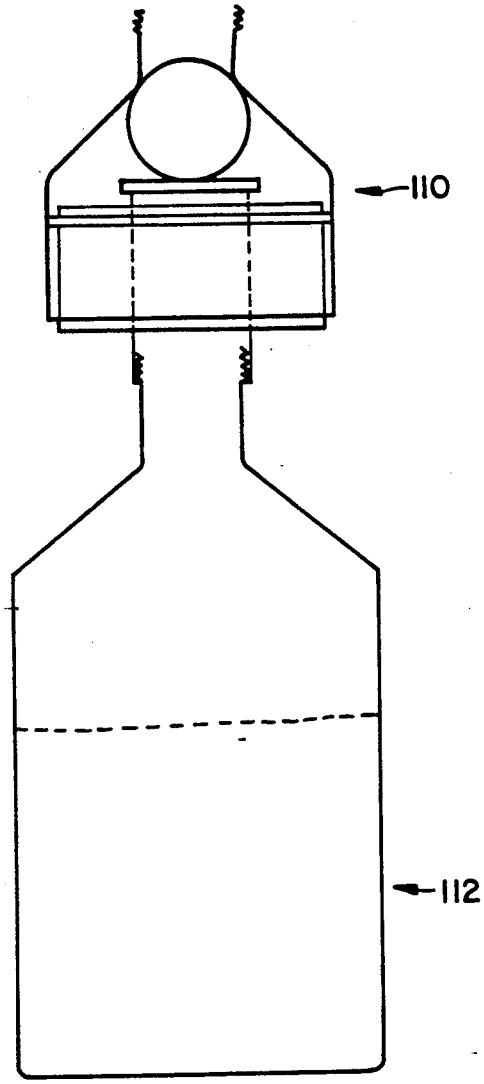

FIGS. 12 and 13 illustrate an alternate way to use the device 110 and assembly 110, 112, having the expansible-condensible body, this alternate way is useful regardless of whether the container sidewall is squeezably flexible, inasmuch as flexing of the container sidewall is not needed.

Instead, the funnel is screwed onto the container, as has been described with reference to FIG. 7. Either before or after the funnel is screwed onto the container but before the funnel-container assembly is inverted, the funnel body 130 is axially condensed causing the round side 174 of the plug 168 to seal closed the tubular outlet neck 156 of the funnel 110. At this stage, the plug 168 is securely trapped in placed, because the bar 172 engages the end 142 of the inlet tube 136, and the ball 170 annularly engages the surface 176 of the wall 158. (See FIG. 12.)

Accordingly, with the user holding the funnel body axially condensed, the funnel-container assembly 110, 112 can be safely inverted and brought into position so that the outlet end of the outlet neck 156 is positioned over whatever structure is the intended receiver of the liquid that is to be poured from the container 112 via the funnel 110.

When the user wants the liquid to begin to pour out from the inverted assembly, the user, while holding the outlet section 134 of the funnel in place, pulls axially upward on the container, causing the funnel chamber 146 to axially expand. This lowers the pressure within the combined headspace of the funnel and container, liquid flows from the container into the funnel chamber, the plug 168 bobs up and rotates 180° while floating (FIG. 13). Thus, the funnel outlet neck is opened, the liquid begins to pour out, and, even as the liquid level becomes low, the bridging effect of the bar 172 prevents the ball 170 from closing the outlet. (However, if the user should wish to terminate outflow of liquid before the container has completely emptied, the user can again condense the funnel body, in the manner that has been explained above with reference to FIG. 11.)

Figure 14:
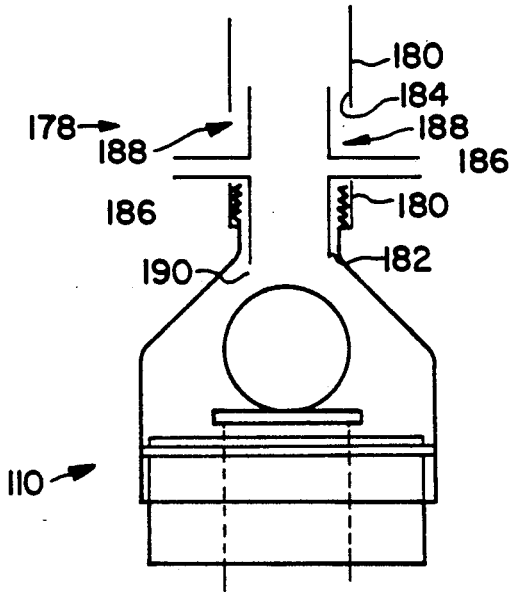
Figure 15:
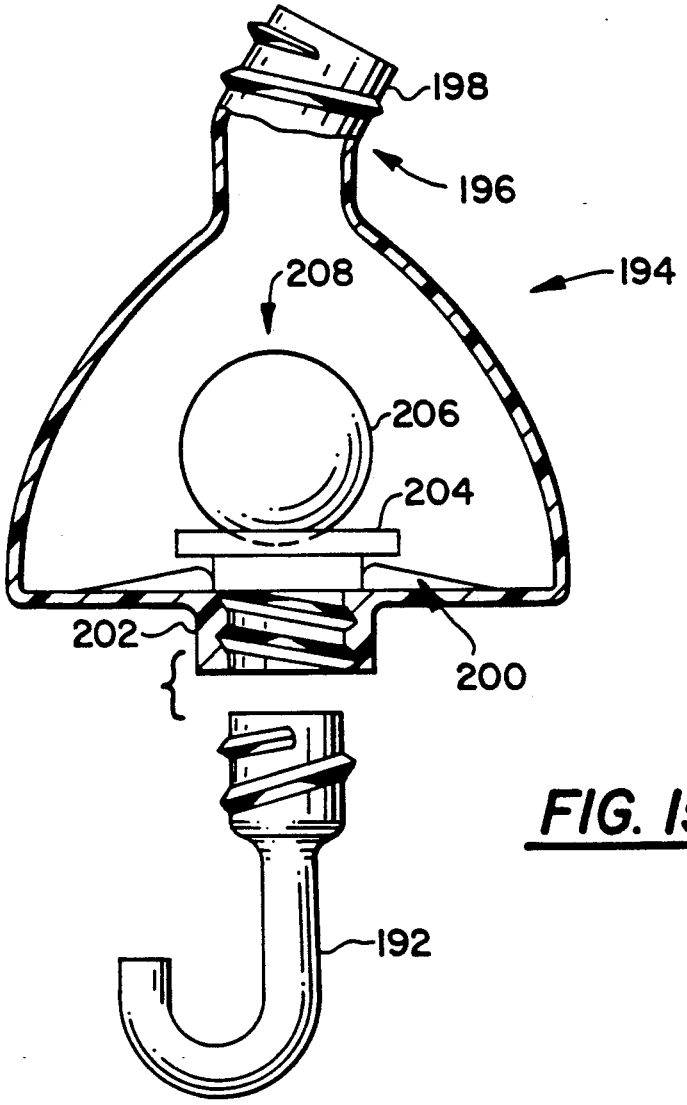

FIGS. 14 and 15 show accessories for use with the funnel 110.

It is possible that sometimes, due to the height of the column of liquid within the container or the relative lack of headspace, the buoyancy of the plug 168 might not readily cause the ball to come loose from the sealing relation provided at 174, 176. For use in such instances, the funnel may usefully further include (as an integrated feature as an add-on adapter 178 as shown in FIG. 14), a means for poking the plug upwards, i.e., for mechanically disrupting the seal at 174, 176, so that the plug will bob upwards and invert in the inverted assembly 110/112.

The adapter 178 is shown comprising an open tube 180 which, by threading at one end, can screw onto the outer end of the outlet tube of the funnel, to thereby serve as an extension of that outlet tube. The tube 180 is shown having a tubular poker 182 axially slidingly received in its throughbore 184. The poker 182 is adapted to be manually reciprocated in the bore 184, by having one or more actuator handles 186 which protrude transversally therefrom, out through respective longitudinal slots 188 in the tube 180. The poker 182 and slots 188 are sufficiently long, that the poker can be retracted out of the way until it is needed, then manually slid so that its end 190 jostles the plug 168, breaking the seal at 174, 176, so that the liquid can flow out through the funnel neck outlet. Other means (e.g., see FIG. 15) could be utilized for dislodging the floater.

The adapter 178 (or the integrated feature thereof, if it is made, instead, integrally with the outlet neck of the funnel) can be used with any and all of the embodiments of the invention.

FIG. 15 shows a simple version of the funnel 194, having a curvature (at 196) in the outlet neck 198 and a rib 200 inside the funnel at the inlet neck 202. The curvature of the neck (when liquid is pouring out) allows the height of the liquid to be reduced and the bar 204 to be positioned in such a way that the forces on the ball 206 are reduced permitting the floater 208 to easily come out of a sealed position when the squeeze on the container (not shown) is relaxed. The rib 200 prevents the possibility of the floater 208 sealing off the flow of liquid as it pours out at the inlet neck 202.

Lastly, inasmuch as it may often be convenient to store the funnel 110, when it is not in use, conveniently close to the place where it is normally used, there may be provided as an accessory a J-hook plug 192 (FIG. 15) which can removably secure to the funnel, as shown, for hanging the funnel, e.g., at a convenient location under the engine compartment hood (or bonnet) of an automobile.

It should now be apparent that the outlet funnel with oriented floating stopper, for pouring from liquid container while secured thereto, as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. An outlet funnel for pouring a liquid from a container through a neck of the container, said outlet funnel comprising:

funnel body wall means defining a funnel chamber;

an inlet tube penetrating said wall means into said chamber; said inlet tube having an outer end exposed outside said outlet funnel, and an inner end exposed to said chamber;

a tubular outlet neck penetrating said wall means into said chamber; said outlet neck having an outer end exposed outside said outlet funnel, and an inner end exposed to said chamber;

means on said outer end of said inlet tube for connecting said outlet funnel to a neck of a container to serve as an extension of said neck for conducting into said outlet funnel fluid contained in said container;

said wall means including internal guide surface means within said chamber which taper towards said inner end of said outlet neck and flare towards said inner end of said inlet tube;

a plug disposed within said chamber; said plug having an eccentric center of gravity displaced away from a lighter end thereof towards a heavier end thereof; said plug being sufficiently low in density as to be buoyant in a liquid which is to be poured out of said container through said outlet funnel;

said plug being arranged to effectively sealingly close said inner end of said outlet funnel when oriented with said lighter end in confronting relation thereto;

said heavier end of said plug being shaped to permit liquid flow therepast from said container into said chamber when oriented in confronting relation to said inner end of said inlet tube, and to permit liquid flow therepast from said chamber into said outlet neck when oriented in confronting relation to said inner end of said outlet neck, by said plug being externally configured as a ball having a given diameter which is substantially centered at one end thereof on said lighter end of said plug and at an opposite end thereof on said heavier end of said plug, and a transversally extending bar means based on said ball at said heavier end of said plug; said bar means being discontinuous circumferentially of said plug about said axis, so as to provide at least one passageway axially past said bar means from said heavier end of said plug; and said funnel body wall means being arranged to provide a condition of use in which said plug is free to rotate while buoyed on said liquid within said chamber for permitting a desired amount of liquid to flow past said plug and out of said funnel through said outlet neck.

2. The outlet funnel of claim 1, wherein:

said plug is arranged to effectively sealingly close said inner end of said inlet tube when oriented with said lighter end in confronting relation thereto; and said funnel body wall means includes means manually actuable for axially elongating and condensing said chamber for alternatively freeing said plug to rotate while buoyed on said liquid and trapping said plug with said lighter end thereof effectively in sealingly closing relation with a selected one of said inner end of said inlet tube and said inner end of said outlet neck.

3. The outlet funnel of claim 2, wherein:

said funnel body wall means provides two sealingly, telescopically slidably related members, which are arranged to slide for elongating and condensing said chamber.

4. The outlet funnel of claim 1, wherein:

said means for connecting said outer end of said inlet tube to said neck of said container comprises a band of helical threading circumferentially provided on said outer end of said inlet tube.

5. The outlet funnel of claim 4, further including:

a band of helical threading provided on said outer end of said outlet neck; said threading on said inlet tube being complimentary to said threading on said outlet neck, so that a closure cap unscrewed from said neck of said container, can be alternatively screwed onto said outlet end of said outlet neck of said outlet funnel.

6. The outlet funnel of claim 1, further including:

poker means provided within said outlet neck and accessible from exteriorly of said outlet funnel for mechanically pushing said lighter end of said plug effectively out of sealing relation to said inner end of said outlet tube while said chamber is arranged to permit said plug to buoyantly rotate on said liquid.

7. The outlet funnel of claim 1, further including:

hanger means provided on said outlet funnel for use in hangingly storing said outlet funnel convenient to a place of use.

8. The outlet funnel of claim 7, wherein:

said hanger means comprises a J-plug which is disengageably secured to said outlet funnel.

9. The outlet funnel of claim 1, wherein:

said inner end of said inlet tube and said inner end of said outlet neck being disposed in axially spaced, generally confronting relation within said chamber; and said funnel body wall means for providing said condition of use, being arranged to permit said plug to rotate, while buoyed on said liquid within said chamber from an orientation in which said lighter end of said plug confronts said inner end of said outlet neck, to an orientation in which said lighter end of said plug confronts said inner end of said inlet tube.

10. The outlet funnel of claim 9, wherein:

said inner end of said outlet neck is tilted with respect to said inner end of said inlet tube.

11. The outlet funnel of claim 9, wherein:

said wall means further include rib means located within said funnel chamber adjacent said inner end of said inlet tube and arranged for effectively preventing said plug from sealingly closing said inner end of said inlet tube.

* * * * *